US006886188B2

(12) United States Patent
Epple et al.

(10) Patent No.: US 6,886,188 B2
(45) Date of Patent: May 3, 2005

(54) AUTOMATIC POOL COVER BOX LID SUPPORT BRACKET ASSEMBY

(75) Inventors: Thomas A. Epple, Fort Wayne, IN (US); Lanny R. Smith, Alpine, UT (US)

(73) Assignee: Fort Wayne Pools, Inc., Ft. Wayne, IN (US)

( * ) Notice: Subject to any disclaimer, the term of this patent is extended or adjusted under 35 U.S.C. 154(b) by 363 days.

(21) Appl. No.: 10/007,551

(22) Filed: Nov. 8, 2001

(65) Prior Publication Data

US 2003/0084502 A1 May 8, 2003

(Under 37 CFR 1.47)

(51) Int. Cl.[7] ..... E04H 4/00
(52) U.S. Cl. ..... 4/502

(58) Field of Search ..... 4/500, 502

(56) References Cited

U.S. PATENT DOCUMENTS

| | | | | | |
|---|---|---|---|---|---|
| 2,982,508 | A | * | 5/1961 | Larsen et al. | 248/205.1 |
| 6,324,706 | B1 | | 12/2001 | Epple | |
| 6,384,726 | B1 | | 5/2002 | Epple et al. | |
| 6,393,632 | B1 | | 5/2002 | Epple | |
| 6,446,276 | B2 | | 9/2002 | Mathis | 4/502 |
| 2002/0050004 | A1 | | 5/2002 | Epple | |
| 2002/0162167 | A1 | | 11/2002 | Epple | |
| 2003/0084501 | A1 | | 5/2003 | Epple et al. | |
| 2003/0084503 | A1 | | 5/2003 | Epple | |

* cited by examiner

*Primary Examiner*—Charles E. Phillips

(57) ABSTRACT

A lid support bracket assembly for supporting a pool cover box lid includes a wall mount and a bracket angularly adjustably coupled to the wall mount.

20 Claims, 5 Drawing Sheets

AUTOMATIC POOL COVER BOX LID SUPPORT BRACKET ASSEMBY

BACKGROUND OF THE INVENTION

1. Field of the invention

The present invention relates to swimming pools, and, more particularly, to an automatic pool cover box lid support bracket.

2. Description of the Related Art

Swimming pools are commonly covered to prevent debris from entering the pool, to preserve chemical treatments in the water and to heat the pool in the case of a solar cover. An automatic pool cover provides convenience for a user by allowing the cover to be easily extended over the pool during periods of non-use, and retracted during periods of use. Typically, a box is placed in the decking surrounding the swimming pool at a location opposite from the walk-in steps (usually at the deep end of a pool). The box extends across the width of the swimming pool, and houses an electric motor and reel on which the cover is wound.

A problem with conventional automatic pool cover boxes is that the lid which covers the box is typically installed without sufficient support under the body of the lid. If a person steps on a pool cover box lid the pool cover box lid may deform and may cause damage to the pool cover box lid.

Another problem with conventional automatic pool cover boxes is that angular adjustment of the pool cover box lid entails the bending of supports.

What is needed in the art is an automatic pool cover box lid which is adequately supported and easy to angularly adjust.

SUMMARY OF THE INVENTION

The present invention provides an automatic pool cover box lid support bracket assembly having a lid support, an angular adjustment and a wall mount assembled from modular components which may be easily connected together on-site and adjusted relative to each other to provide an optimum installation.

The invention comprises, in one form thereof, a lid support bracket assembly for supporting a pool cover box lid including a wall mount and a bracket adjustably coupled to the wall mount.

The invention comprises, in another form thereof, a pool cover box assembly for housing a swimming pool cover, including a plurality of vertical walls, including a rear wall, a lid having a rear edge, the rear edge being removably engaged with the rear wall and a plurality of lid support bracket assemblies supporting the lid. Each lid support bracket assembly including a wall mount attached to the rear wall and a bracket adjustably coupled to the wall mount.

An advantage of the present invention is that the pool cover box lid support bracket provides support to the pool cover lid.

A further advantage is the pool cover lid support bracket provides an angular adjustment to allow a pool cover box lid to be properly adjusted relative to a swimming pool deck resulting in an aesthetically pleasing look.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
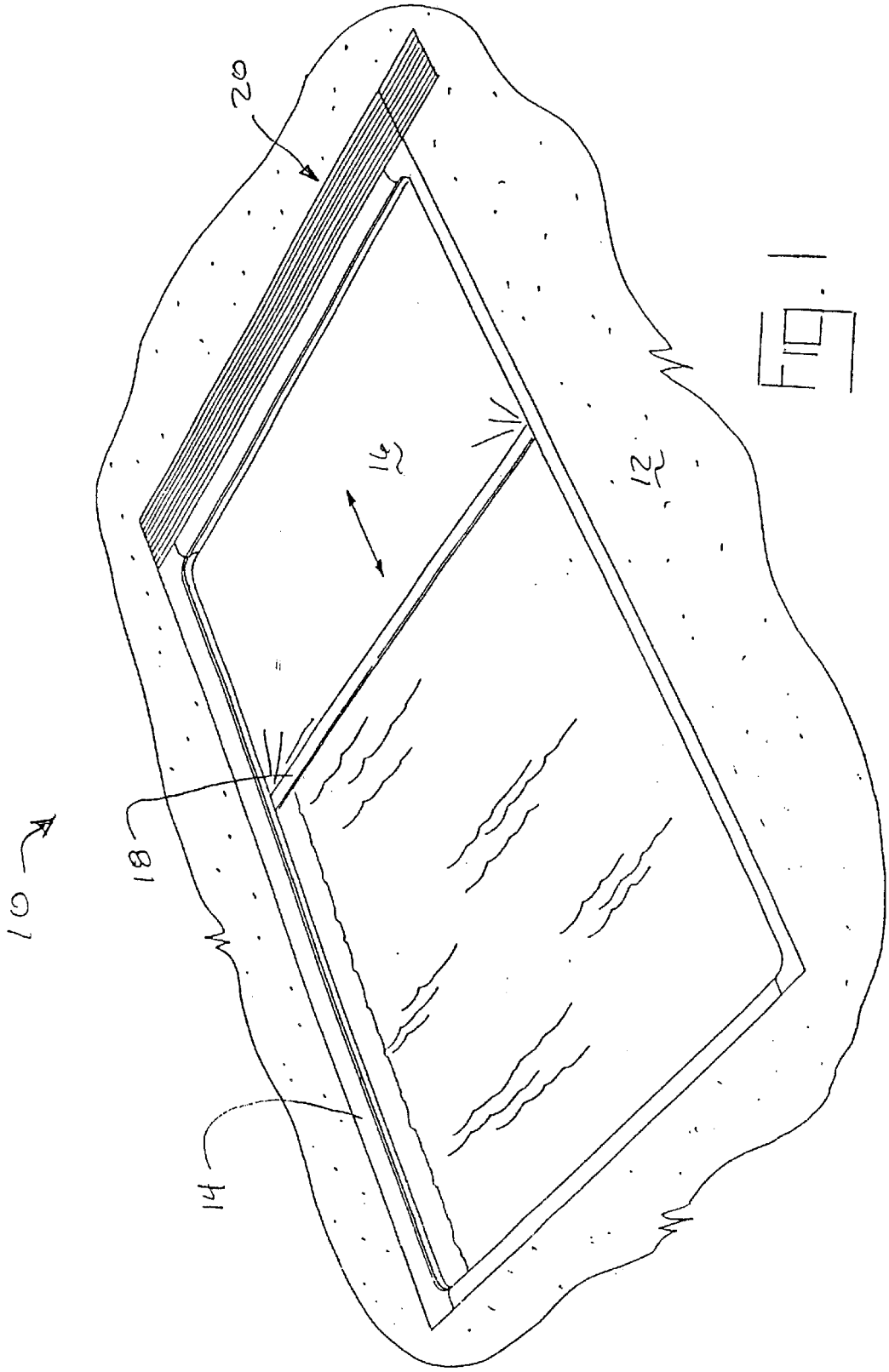
FIG. 1 is a perspective view of a swimming pool including an embodiment of an automatic pool cover box assembly of the present invention.

Referring now to the drawings, and more particularly to FIG. 1, there is shown an embodiment of swimming pool 10 with deck 12, coping 14, cover 16, leading edge bar 18 and pool cover box assembly 20 of the present invention.

Deck 12 is generally horizontal and is preferably constructed from concrete. Coping 14 connects to deck 12 in a substantially coplanar fashion along the edge of deck 12 facing the interior of swimming pool 10.

Coping 14 is connected to deck 12 and provides a track allowing leading edge bar 18 to slide therein. The general shape of the exposed portion of coping 14 is generally curved such that there are no exposed sharp corners. Coping 14 may include a provision to retain a fiber optic light along the length of coping 14 and above the level of leading edge bar 18 and cover 16. Coping 14 also includes a liner bead slot similar to liner bead slot 62 (FIG. 3) from which vinyl liner 64 is suspended.

Cover 16 is attached to leading edge bar 18 which pulls cover 16 from pool cover box assembly 20, through an opening existing between pool cover box assembly 20 and a top edge of swimming pool 10, across the length of swimming pool 10. To prepare swimming pool 10 for use, cover 16 retracts into pool cover box assembly 20 pulling leading edge bar 18 to the previously described opening.

Leading edge bar 18 is connected to cover 16 and provides support along the leading edge of cover 16. Each end of leading edge bar 18 is connected to at least one cable (not shown) and is slideably connected to a track in coping 14. Leading edge bar 18 is shaped in a manner to be unobtrusive and aesthetically pleasing when located at either end of swimming pool 10.

Figure 2:
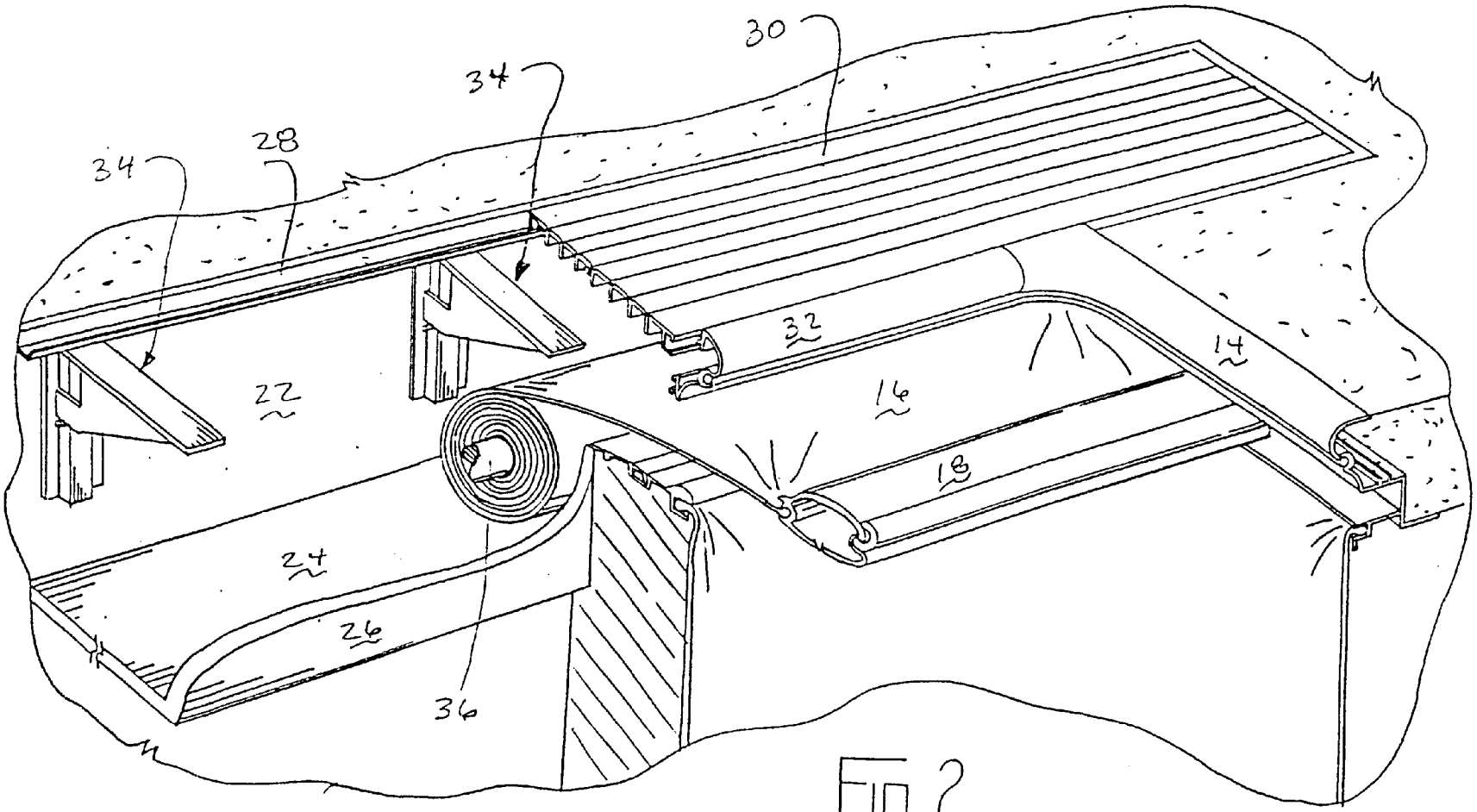
FIG. 2 is a partially sectioned perspective view of the automatic pool cover box assembly shown in FIG. 1.
Figure 3:
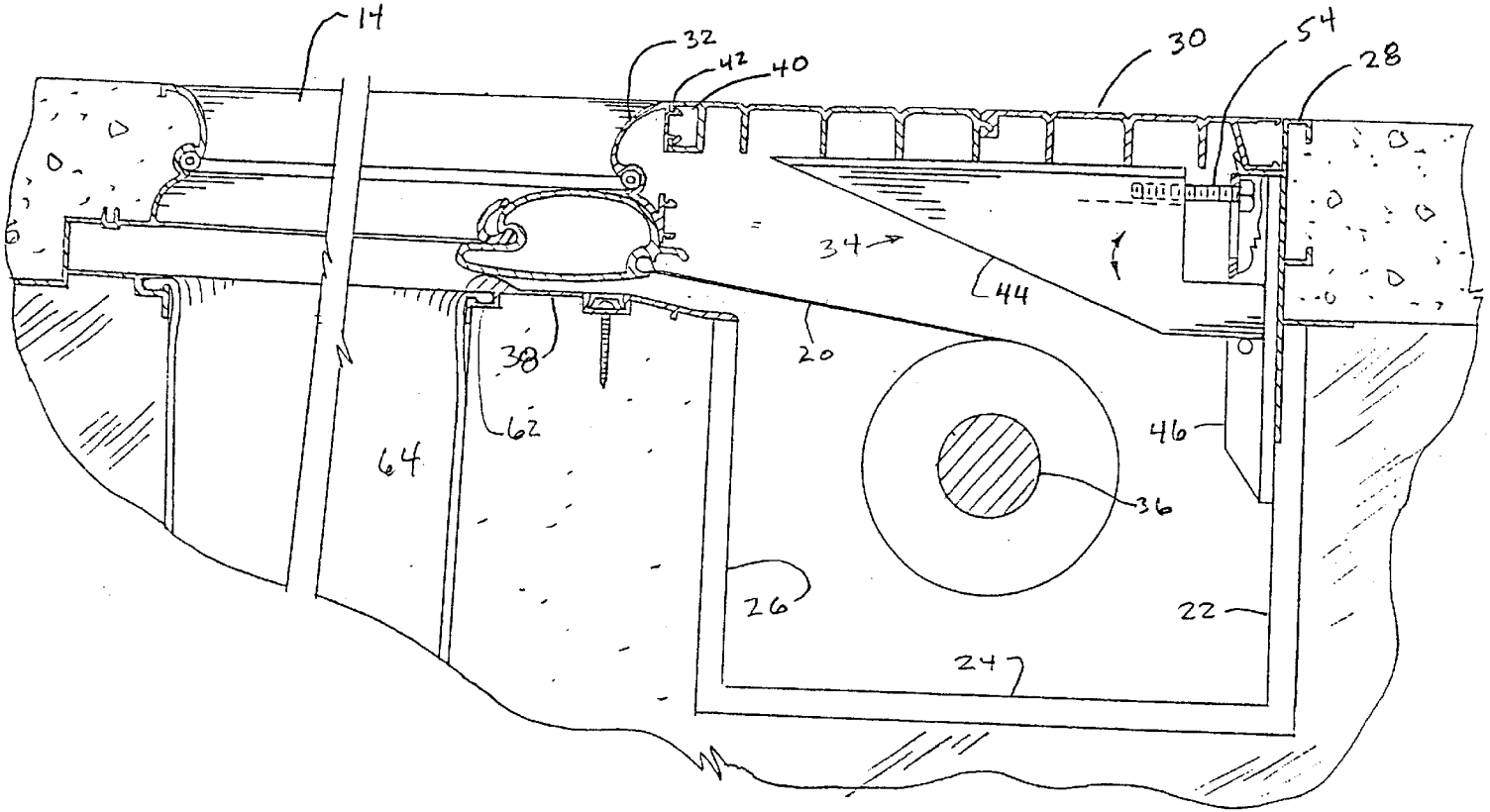
FIG. 3 is an end, sectional view of the automatic pool cover box assembly of FIGS. 1 and 2.

Now additionally referring to FIGS. 2 and 3, pool cover box assembly 20 includes a rear wall 22, a bottom 24, a front wall 26, a coupling 28, lid 30, lid edge support 32 and a plurality of lid support bracket assemblies 34. Pool cover box assembly 20 houses cover 16, reel 36 and a drive mechanism (not shown) which drives reel 36 and a rope and pulley system for the extension and retraction of cover 16. When cover 16 is retracted from swimming pool 10, cover 16 is wrapped around reel 36 a number of times corresponding to the length of swimming pool 10.

Rear wall 22, bottom 24 and front wall 26 are arranged to form three sides of pool cover box assembly 20 adjacent and generally parallel to one end of swimming pool 10. The top edge of front wall 26 is parallel to a plane formed by deck 12 and is disposed therebelow. End cap coping 38 rests on and finishes the top edge of front wall 26.

Coupling 28 has protrusions along a back side to engage the concrete of deck 12 and has an L-shaped upper portion, extending from a front side, to accommodate a portion of lid 30. The top edge of coupling 28 is substantially coplanar with deck 12 and forms part of rear wall 22. Coupling 28 may be formed as an extrusion of metal or plastic.

Lid 30 is composed of two substantially identical extrusions having a coupling mechanism to engage the two extrusions. The rear edge of lid 30 is shaped to engage coupling 28 so that lid 30 does not slide from its intended position. The front edge of lid 30 has a C-shaped channel 40 to accommodate latching projections 42 of lid edge support 32. As an alternative to the two piece construction of lid 30, lid 30 may be made of one or more than two piece construction.

Lid edge support 32 is fastened to lid 30 and is disposed above end cap coping 38 forming an opening therebetween. This opening is generally parallel with the plane of deck 12 and is such that cover 16 may be freely extended over swimming pool 10 and retracted into pool cover box assembly 20. Lid edge support 32 provides support to the front edge of lid 30 reducing the amount of deformation along the front edge of lid 30.

Figure 4:
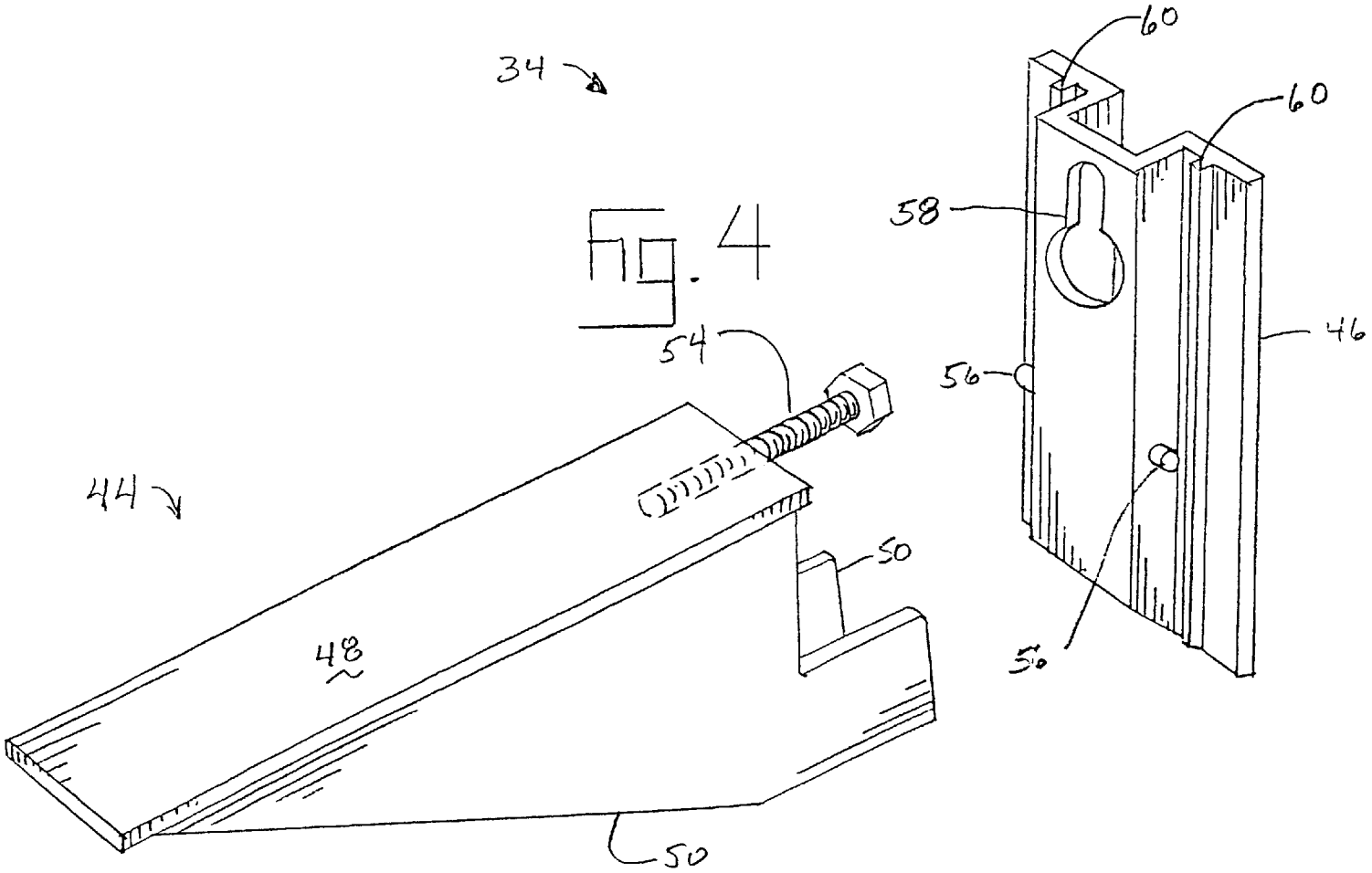
FIG. 4 is a perspective view of the lid support bracket of FIGS. 2 and 3.

According to an aspect of the present invention, and additionally referring to FIG. 4, lid support bracket assemblies 34 include bracket 44 and wall mount 46. Lid support bracket assembly 34 extends over the top of reel 36 and provides support to lid 30. Lid support bracket assemblies 34 are vertically positioned such that bracket 44 accommodates the thickness of lid 30. Lid support bracket assemblies 34 are adjustable such that lid 30 can be positioned at a desired angle to deck 12 or such that lid 30 is substantially coplanar with deck 12.

Bracket 44 includes a load bearing portion 48, supports 50, female threaded coupling and bolt 54. Bolt 54 engages female threaded coupling 52 of bracket 44 and slot 58 of wall mount 46. This arrangement allows lid support bracket assembly 34 to resist downward force conveyed thereto, yet be easily removed by lifting bracket 44 and disengaging the head of bolt 54 from slot 58 of wall mount 46.

Load bearing portion 48 is generally flat on the top portion and is connected on the underneath side to two supports 50. Female threaded coupling 52 is attached between supports 50 to the underneath side of load bearing portion 48. Alternatively, load bearing portion 48 may be an extrusion and female threaded coupling 52 may be integral thereto.

Supports 50 are generally parallel to each other and the top edges of supports 50 are connected to the bottom side of load bearing portion 48. The rear edges of supports 50 are shaped and positioned to engage wall mount 46 and to rest on support pins 56.

Bolt 54, is threadably engaged with female threaded coupling 52. The rotational position of bolt 54 is used to adjust the angle of bracket 44 to accommodate the positioning of lid 30 and provide support thereto. The head of bolt 54 couples with wall mount 46. The angle of bracket 44, and hence the angle of lid 30, is adjustable by a rotational adjustment of bolt 54. For example, to raise the front edge of lid 30, bolt 54 is engaged further into female threaded coupling 52.

Wall mount 46 is broadly U-shaped and includes support pins 56, slot 58 and protrusions 60. A plurality of wall mounts 46 are attached to rear wall 34 in a spaced manner to accommodate the mounting of a similar number of brackets 44. The U-shaped cross-section of wall mount 46 accommodates the thickness of the head of bolt 54. Wall mount 46 has protrusions 60, which run vertically, to captivate bracket 44. Wall mounts 46 are vertically positioned on rear wall 34 to establish a base vertical position for brackets 44.

Slot 58 of wall mount 46 has a circularly shaped portion to accommodate the insertion of the head of bolt 54 at the lower end of slot 58 and slot 58 narrows at the upper end to accommodate passage of the shaft of bolt 54. The arrangement of slot 58 serves to captivate bolt 54.

Support pins 56 on wall mount 46 are provided to accommodate bracket 44 and are located to provide vertical positioning to bracket 44 such that the rear edge of lid 30 is substantially at the same height as deck 12. Support pins 56 on wall mount 46 are positioned to constrain the movement of bracket 44 and to transfer the vertical component of the load from bracket 44 to rear wall 22.

Figure 5:
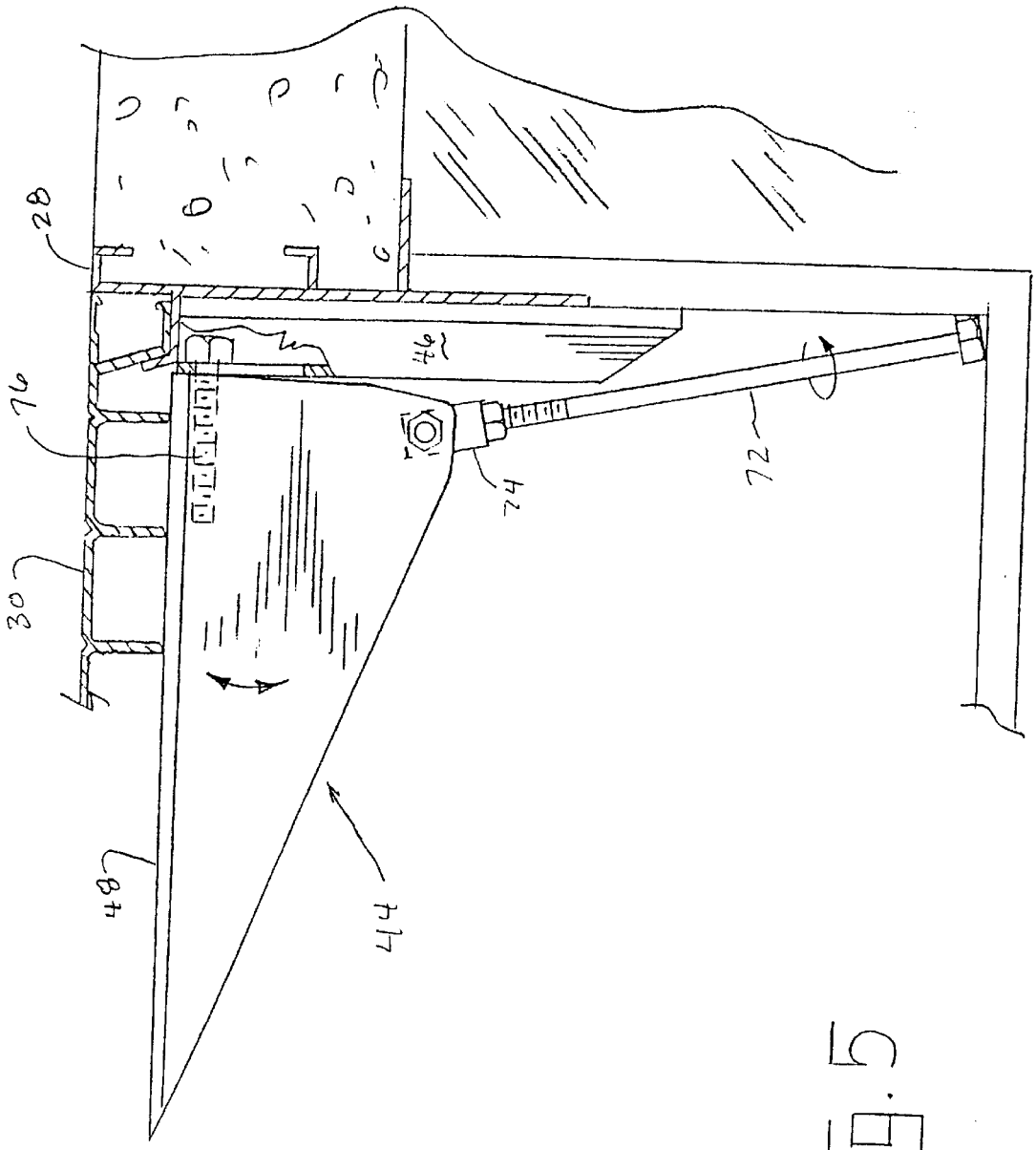
FIG. 5 is an end, sectional view of another embodiment of a lid support bracket of the present invention.

Now referring to FIG. 5, another embodiment of bracket 44 of the present invention is shown. In this embodiment, bracket 44 is substantially similar to the previous embodiment, but bracket 44 additionally includes a bolt 72, a pivoting coupling 74 and a bolt 76. Pivoting coupling 74 is attached to bracket 44 in a pivotal manner and is threadably engaged with bolt 72. The head of bolt 72 is positioned in the corner formed by the intersection of bottom 24 and rear wall 22.

Bolt 76 is threadably engaged with bracket 44 and the head of bolt 76 is constrained in a slot of wall mount 46. Wall mount 46 is substantially the same as that of the previous embodiment, yet without the need for support pins 56. Bracket 44 is adjusted by rotating bolt 72 and bolt 76 to properly position bracket 44.

To install a lid support bracket assembly 34 in a pool cover box, wall mounts 46 are positioned along and attached to rear wall 22. Bolt 54 is threadably engaged into female threaded coupling 52 of each bracket 44. The head of bolt 54 is inserted into the generally circular opening of slot 58 in wall mount 46. Bolt 54, along with bracket 44, is then slid upward into a narrowed portion of slot 58 thereby captivating bolt 54 to wall mount 46. Bracket 44 is raised sufficiently so that it can be rotated downward to engage wall mount 46 and set upon support pins 56 of wall mount 46.

Once brackets 44 are installed, pool cover box lid 30 is assembled to rear wall 22 of pool cover box 20 and pool cover box lid 30 is lowered onto brackets 44. If pool cover box lid 30 is not positioned at the desired angle then pool cover box lid 30 is removed and brackets 44 are removed, bolts 54 adjusted and brackets 44 and pool cover box lid 30 are reinstalled as previously discussed.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A swimming pool, comprising:

a cover configured to cover said swimming pool; and a pool cover box assembly for containing said cover, comprising:

a plurality of vertical walls, including a rear wall;

a lid having a rear edge, said rear edge being removably engaged with said rear wall; and a plurality of lid support bracket assemblies supporting said lid, each lid support bracket assembly comprising:

a wall mount attached to said rear wall; and a bracket angularly adjustably coupled to said wall mount.

2. The swimming pool of claim 1, said plurality of lid support bracket assemblies further comprising:

an angular adjusting device having a first end and a second end, said first end being connected to said bracket, and said second end being connected to said wall mount.

3. The swimming pool of claim 2, wherein said angular adjusting device is a bolt, said first end of said bolt being threadably engaged with said bracket, said second end of said bolt being a head, said wall mount having a slot, said head being removably captivated in said slot.

4. The swimming pool of claim 1, wherein said plurality of vertical walls further comprise a front wall having a top surface, said lid being disposed above said top surface of said front wall thereby forming an opening therebetween, said opening configured for the passage of said cover therethrough.

5. The swimming pool of claim 1, wherein said bracket further comprises:

a load bearing portion having a top side and a bottom side, said top side of said load bearing portion being configured to accommodate said bottom side of said lid; and a plurality of supports each having a top edge and a back edge, each said top edge of said support being connected to said bottom side of said load bearing portion and substantially perpendicular thereto, said supports aligned substantially parallel to each other.

6. The swimming pool of claim 1, wherein said wall mount has a U-shaped cross-section and a coupling slot.

7. The swimming pool of claim 6, wherein said wall mount is an extrusion.

8. The swimming pool of claim 6, wherein said wall mount further includes at least one support pin being horizontally arranged to accommodate said bracket.

9. A pool cover box assembly for housing a swimming pool cover, comprising:

a plurality of vertical walls, including a rear wall;

a lid having a rear edge, said rear edge being removably engaged with said rear wall; and a plurality of lid support bracket assemblies supporting said lid, each said lid support bracket assembly comprising:

a wall mount attached to said rear wall; and a bracket angularly adjustably coupled to said wall mount.

10. The pool cover box assembly of claim 9, said plurality of lid support bracket assemblies further comprising:

an angular adjusting device having a first end and a second end, said first end being connected to said bracket, and said second end being connected to said wall mount.

11. The pool cover box assembly of claim 10, wherein said angular adjusting device is a bolt, said first end of said bolt being threadably engaged with said bracket, said second end of said bolt being a head, said wall mount having a slot, said head being removably captivated in said slot.

12. The pool cover box assembly of claim 9, wherein said plurality of vertical walls further comprise a front wall having a top surface, said lid being disposed above said top surface of said front wall thereby forming an opening therebetween, said opening configured for the passage of said cover therethrough.

13. The pool cover box assembly of claim 9, wherein said bracket further comprises:

a load bearing portion having a top side and a bottom side, said top side of said load bearing portion being configured to accommodate said bottom side of said lid; and a plurality of supports each having a top edge and a back edge, each said top edge of said support being connected to said bottom side of said load bearing portion and substantially perpendicular thereto, said supports aligned substantially parallel to each other.

14. The pool cover box assembly of claim 9, wherein said wall mount has a U-shaped cross-section and a coupling slot.

15. The pool cover box assembly of claim 14, wherein said wall mount is an extrusion.

16. The pool cover box assembly of claim 14, wherein said wall mount further includes at least one support pin being horizontally arranged to accommodate said bracket.

17. A method of installing a lid support bracket assembly into a pool cover box, comprising the steps of:

providing a pool cover box having a rear wall;

engaging a threaded end of a bolt into a female threaded portion of a bracket;

inserting the head of said bolt into a generally circular opening of a slot in a wall mount, said wall mount being attached to said rear wall;

sliding said bolt in said slot, said slot narrowing thus captivating said bolt; and rotating said bracket to engage said wall mount and support pins on said wall mount.

18. The method of claim 17, further comprising the steps of:

assembling a rear edge of a pool cover box lid to said rear wall of said pool cover box; and lowering said pool cover box lid onto said bracket.

19. The method of claim 18, further comprising the step of:

assessing if said pool cover box lid is level with a pool deck and if said pool cover box lid is not substantially level with said pool deck then further comprising the steps of:

removing said pool box cover lid and said bracket;

adjusting said bolt; and repeating said inserting, said sliding, said rotating, said assembling and said lowering steps.

20. The method of claim 17, wherein said method is repeated for a plurality of lid support bracket assemblies in said pool cover box.

* * * * *